US005918543A

United States Patent [19]

Becker et al.

[11] Patent Number: 5,918,543

[45] Date of Patent: Jul. 6, 1999

[54] ADJUSTING DEVICE FOR A GRIPPER OPENING CAM IN A CHAIN DELIVERY OF A SHEET-RED PRINTING PRESS

[75] Inventors: Willi Becker, Bammental; Jürgen Rautert, Heidelberg; Ralf Wadlinger, Ludwigshafen, all of Germany

[73] Assignee: Heidelberger Druckmaschinen AG, Heidelberg, Germany

[21] Appl. No.: 08/953,753

[22] Filed: Oct. 17, 1997

[30] Foreign Application Priority Data

Oct. 17, 1996 [DE] Germany ..... 196 42 804

[51] Int. Cl.[6] ..... B65H 29/04

[52] U.S. Cl. ..... 101/232; 271/204; 271/205

[58] Field of Search ..... 271/277, 82, 204, 271/205; 101/232, 246

[56] References Cited

U.S. PATENT DOCUMENTS 4,643,414 2/1987 Weisgerber ..... 271/183

5,707,058 1/1998 Hirth et al. ..... 271/176

*Primary Examiner*—Edgar Burr

*Assistant Examiner*—Daniel J. Colilla

*Attorney, Agent, or Firm*—Herbert L. Lerner; Laurence A. Greenberg

[57] ABSTRACT

An adjusting device for a gripper opening cam in a chain delivery of a sheet-fed printing press, the gripper opening cam being pivotally guided in a bearing and being connected by a linkage to one of a pair of threaded nuts of a combination of a lefthand and righthand thread of an adjusting shaft screwable into a fixedly supported other threaded nut of the combination, includes an adjusting motor with an electrical program controller programmable for adapting to parameters which vary as the printing press rpm runs up to and runs down from operating speed for automatically tracking the gripper opening cam, and a coupling operative in the adjusting device, the coupling being disposed between the adjusting motor and the gripper opening cam.

10 Claims, 7 Drawing Sheets

ADJUSTING DEVICE FOR A GRIPPER OPENING CAM IN A CHAIN DELIVERY OF A SHEET-RED PRINTING PRESS

BACKGROUND OF THE INVENTION

FIELD OF THE INVENTION

The invention relates to an adjusting device for a gripper opening cam in a chain delivery of a sheet-fed printing press, wherein the gripper opening cam is pivotally guided in a bearing and is connected by a coupling transmission or linkage to one of a pair of threaded nuts of a combination of a lefthand and righthand thread of an adjusting shaft screwable into a fixedly supported other threaded nut of the combination.

Such an adjusting device has become known heretofore from the published German Patent Document DE 43 35 230 A1. The gripper opening cam, as in the published German Patent Document 30 02 591 C2, is disposed so as to be pivotable about an approximately horizontal axis. The combination of the lefthand/righthand thread includes a first threaded nut, which is braced in the machine frame and has a threaded spindle of the adjusting shaft threaded therethrough, and a second threaded nut having a thread running counter to the first threaded nut. The second threaded nut is disposed on the coupling transmission or linkage and has a correspondingly oppositely directed threaded spindle of the adjusting shaft threaded therethrough, so that changes in the rotary angle have the effect upon the coupling transmission or linkage of doubling the thread pitch. The adjustment is generally performed manually through the intermediary of a hand wheel disposed on a free end of the adjusting shaft. Whatever position has been set is indicated directly on the adjusting shaft or on the hand wheel.

From the German Patent 818 365, an hydraulically operated motorized adjusting device for automatically adapting the gripper opening cam position to the machine rpm has become known heretofore, but it is very complicated and does not have the advantages of the mechanically operative adjusting device of the aforementioned German Patent Document DE 43 35 230 A1.

SUMMARY OF THE INVENTION

It is accordingly an object of the invention to provide a mechanical adjusting device for a gripper opening cam in a chain delivery of a sheet-fed printing press according to the prior art with a device for automatically tracking or following-up the gripper opening cam upon a runup and a rundown of the printing press rpm in adapting to varying operating parameters, taking into account the particular printing process involved and the material or stock being printed on, which permits the operator to intervene manually at any time and thereby correct the position of the gripper opening cam.

With the foregoing and other objects in view, there is provided, in accordance with a first aspect of the invention, an adjusting device for a gripper opening cam in a chain delivery of a sheet-fed printing press, the gripper opening cam being pivotally guided in a bearing and being connected by a linkage to one of a pair of threaded nuts of a combination of a lefthand and righthand thread of an adjusting shaft screwable into a fixedly supported other threaded nut of the combination, comprising an adjusting motor with an electrical program controller programmable for adapting to parameters which vary as the printing press rpm runs up to and runs down from operating speed for automatically tracking the gripper opening cam, and a coupling operative in the adjusting device, the coupling being disposed between the adjusting motor and the gripper opening cam.

In accordance with another feature of the invention, the adjusting motor is couplable to the adjusting shaft by a slipping clutch.

In accordance with a further feature of the invention, the adjusting motor is couplable to the adjusting shaft via a shiftable clutch.

In accordance with a further feature of the invention, the shiftable clutch has a control shaft pivotally supported coaxially in the adjusting shaft, the adjusting shaft carrying an entrainer pin.

In accordance with an added feature of the invention, the shiftable clutch has a selector bushing coaxially engaging the adjusting shaft on the outside thereof, the selector bushing having an axial cam on an end face thereof, the axial cam being operatively connected to the entrainer pin.

In accordance with an additional feature of the invention, the adjusting device includes a restoring spring coaxially surrounding the selector bushing, the adjusting shaft and the control shaft and is disposed between the selector bushing and an abutment.

In accordance with yet another feature of the invention, the adjusting device includes a potentiometer connected to the adjusting shaft for feeding actual-value data of the adjusting shaft into the electric controller of the adjusting motor.

In accordance with yet a further feature of the invention, the electronic controller for the adjusting motor is provided with various control programs for various materials to be printed, and varying operating data taking into account the current operating process, and is programmable for an individual adjustment drive for tracking the gripper opening cam when the rpm of the printing press is running up to and running down from operating speed.

In accordance with a second aspect of the invention, there is provided an adjusting device for a gripper opening cam in a chain delivery of a sheet-fed printing press, the gripper opening cam being pivotally guided in a bearing and being connected by a linkage to one of a pair of threaded nuts of a combination of a lefthand and righthand thread of an adjusting shaft screwable into a fixedly supported other threaded nut of the combination, comprising an adjusting motor with an electrical program controller programmable for adapting to parameters which vary as the printing press rpm runs up to and runs down from operating speed for automatically tracking the gripper opening cam, one of the pair of threaded nuts having an external thread and being in axially adjustable engagement with a fixedly disposed internal thread, the one threaded nut being screwable on the fixed thread by one of a hand wheel and a motor, a potentiometer for feeding angular positions of the adjusting shaft into a control program for the adjusting motor, and a drive disposed between and operatively connecting the one threaded nut and the potentiometer.

In accordance with a concomitant feature of the invention, the one threaded nut having the external thread is rotatable through approximately 360° between stops, and the drive of the potentiometer relative to the one threaded nut is limited to a rotation through approximately 360° between stops.

In such an adjusting device, the advantages of the purely mechanical gripper opening cam adjustment, which is also referred to in the aforementioned published German Patent Document DE 43 35 230 A1, remain preserved without impairment. The operator can consequently correct the position of the gripper opening cam at any time either via the hand wheel or optionally by motor. The gripper opening time can accordingly be adjusted automatically with an rpm-adapted, programmable characteristic curve, and the location of the characteristic curve (for example, for various materials or stock to be printed) can be varied manually or by motor. Through the intermediary of a suitable program control of the additional motorized adjustment drive, the position of the gripper opening cam, when the rpm of the sheet-fed printing press runs up to operating speed and when it runs back down again, is adapted automatically to operating conditions which vary in response to mass inertia factors under the influence of whatever material or stock is being printed on and of the current operating process. In practical operation, this type of automatic tracking or follow-up of the gripper opening cam saves the pressman from making long trips, especially upon the rpm runup, but also upon the rpm rundown, when he or she is simultaneously making-ready the delivery, for example, for the sheets. Nevertheless, an arbitrary override by the pressman is possible at any time by hand via the adjusting wheel or optionally by motor, through the intermediary of an adjusting drive, thereby achieving the maximum possible flexibility in terms of different materials or stock to be printed on.

For coupling the adjusting motor, an electronic shifting clutch is suitable, for example.

Preferably, the additional motorized adjustment drive can be coupled to the adjusting shaft by a shiftable clutch or a slipping clutch. In the course of the change in rpm of the machine as it runs up to speed and runs down again, the gripper opening cam is controlled automatically by the program controller of the motorized adjustment drive. A potentiometer connected to the adjusting shaft furnishes the actual-value data of the adjusting shaft for the electrical program controller when the operating rpm is reached at the end of the runup, or upon rundown of the press rpm. With the shiftable clutch or slipping clutch, overriding can be effected at any time on the adjusting shaft by using the hand wheel. For various operating processes, different materials or stock to be printed on and different courses of acceleration and deceleration, respectively, programs for the controller can be prepared and input, accordingly. The shiftable clutch can selectively be actuatable electromagnetically, pneumatically, hydraulically or mechanically.

Other features which are considered as characteristic for the invention are set forth in the appended claims.

Although the invention is illustrated and described herein as embodied in an adjusting device for a gripper opening cam in a chain delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
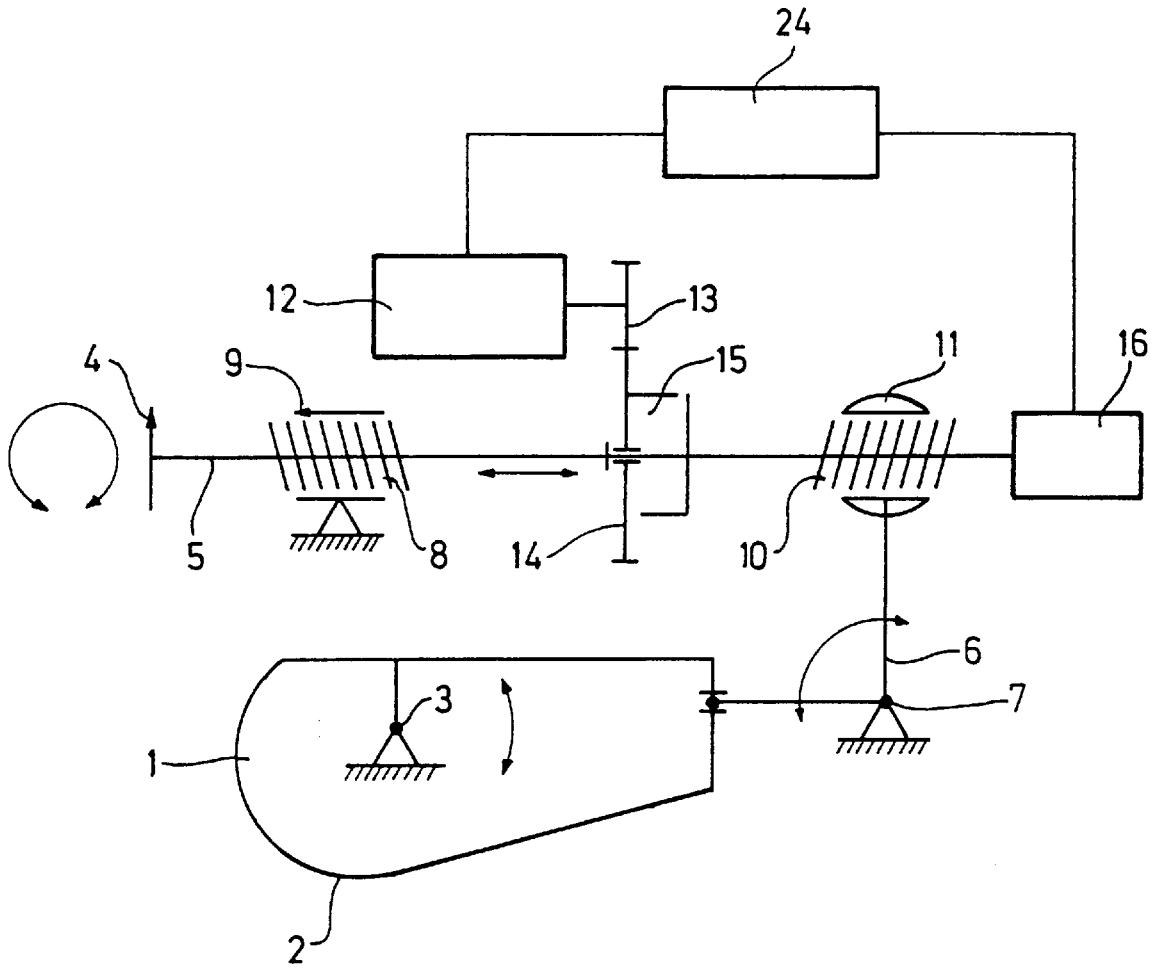
FIG. 1 is a diagrammatic and schematic view of an adjusting device for a gripper opening cam having the characteristic features of the invention.

Referring now to the drawings and, first, particularly to FIG. 1 thereof, there is shown therein a gripper opening cam 1 having a cam path 2 by which it acts against non-illustrated cam rollers of the gripper system guided on revolving chains in a delivery of a sheet-fed printing press, is pivotable in the printing-press frame about a horizontal axis 3 and is longitudinally displaceable, if necessary or desirable. The gripper opening cam 1 is adjustable by a hand wheel 4 on an adjusting shaft 5 which, through the intermediary of a combination of a lefthand/righthand thread acts upon an adjusting lever 6 which is supported in the printing-press frame so as to be pivotable about a pivot axis 7 extending parallel to the axis 3. The adjusting shaft 5 has a first threaded spindle 8 with which it passes through a first threaded nut 9 braced in the press frame, and a second threaded spindle 10 with which it passes through a second threaded nut 11; the thread pitch of the second threaded spindle 10 and of the second threaded nut 11 is directed opposite to that of the first threaded spindle 8 and the first threaded nut 9, so that the respective torsion angles of the adjusting shaft 5 at any given time are transmitted correspondingly reinforced to the adjusting lever 6 and thus to the gripper cam 1.

In addition, an adjusting motor with an electronic program controller is provided, which can be connected to the adjusting shaft 5 via a spur gear transmission 13, 14 through the intermediary of a shiftable slipping clutch 15. The shifting or slipping clutch 15 is operative in either of the opposite directions of the adjusting motion of the adjusting shaft 5, as represented by the associated double-headed arrow, so that adjusting motions originating in the adjusting motor 12 are transmitted to the adjusting shaft 5. In a version of the adjusting device with a slipping clutch, the adjusting motion of the adjusting motor 12 is overridden by a rotary motion of the hand wheel 4. Instead of the hand wheel, or in addition thereto, a motorized adjustment drive mechanism may be provided. Furthermore, a potentiometer 16 is coupled to the adjusting shaft 5 and feeds the respective angular position of the adjusting shaft 5 at a given time and the torsional motion thereof into the control system for the adjusting motor 12.

Figure 2:
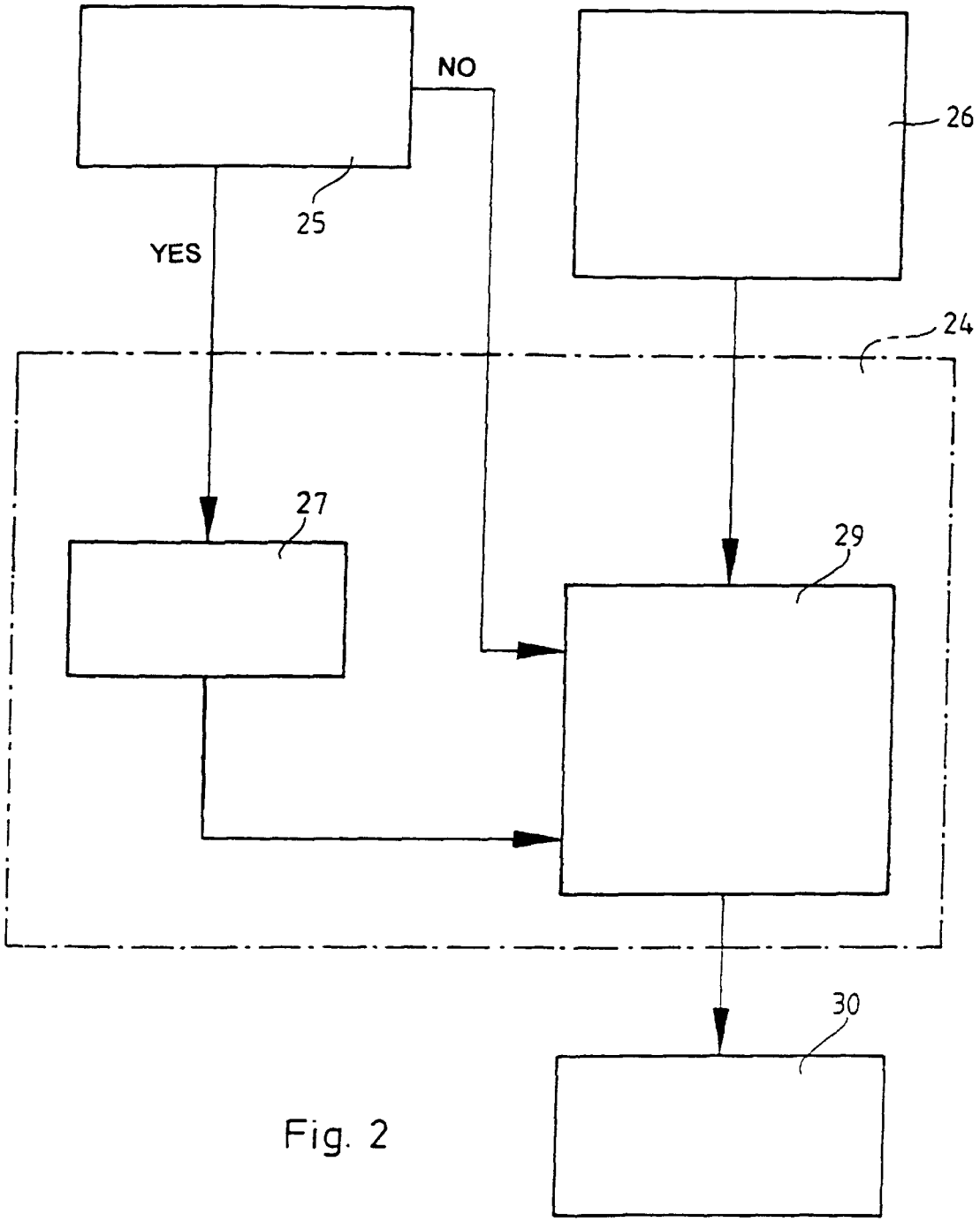
FIG. 2 is a block diagram of the equipment according to the invention for effecting tracking control of the gripper opening cam.

Via this additional adjusting motor with electronic program control, suitable tracking or follow-up of the gripper opening cam, taking into account the recurrent operating process, the material or stock being printed on, and varying operating conditions, takes place automatically upon a runup of the rpm and also upon a rundown of the rpm of the sheet-fed printing press. A block diagram for the electronic control of the adjusting motor 12 for tracking or following-up the gripper opening cam 1 is shown in FIG. 2. An input table 25 of a computer 24 permits the operator to input any necessary or desired control curve. In the computer 24, the press speed and the position of the gripper opening cam 1 can be stored in memory. A conversion to control signals 29 for the motor 12 is performed in the computer 24 as a function of the press speed. Advantageously, these control signals 29 can be stored in the form of a control curve in a buffer memory 27, and nondeletable reference curves can be overwritten, to enable the resumption of the original condition. Control commands for the control motor 12 are called up from this buffer memory 30. The press speed when the earliest gripper opening is attained upon runup of the press rpm is stored in the memory 7 of the computer 24. Upon rundown, this value is then deleted again. There is a stop at this position of the gripper opening cam 1, so that the potentiometer 16 for the control motor 12 will not be overrotated and so that identical runup and rundown curves for the engine control will be obtained.

Figure 3:
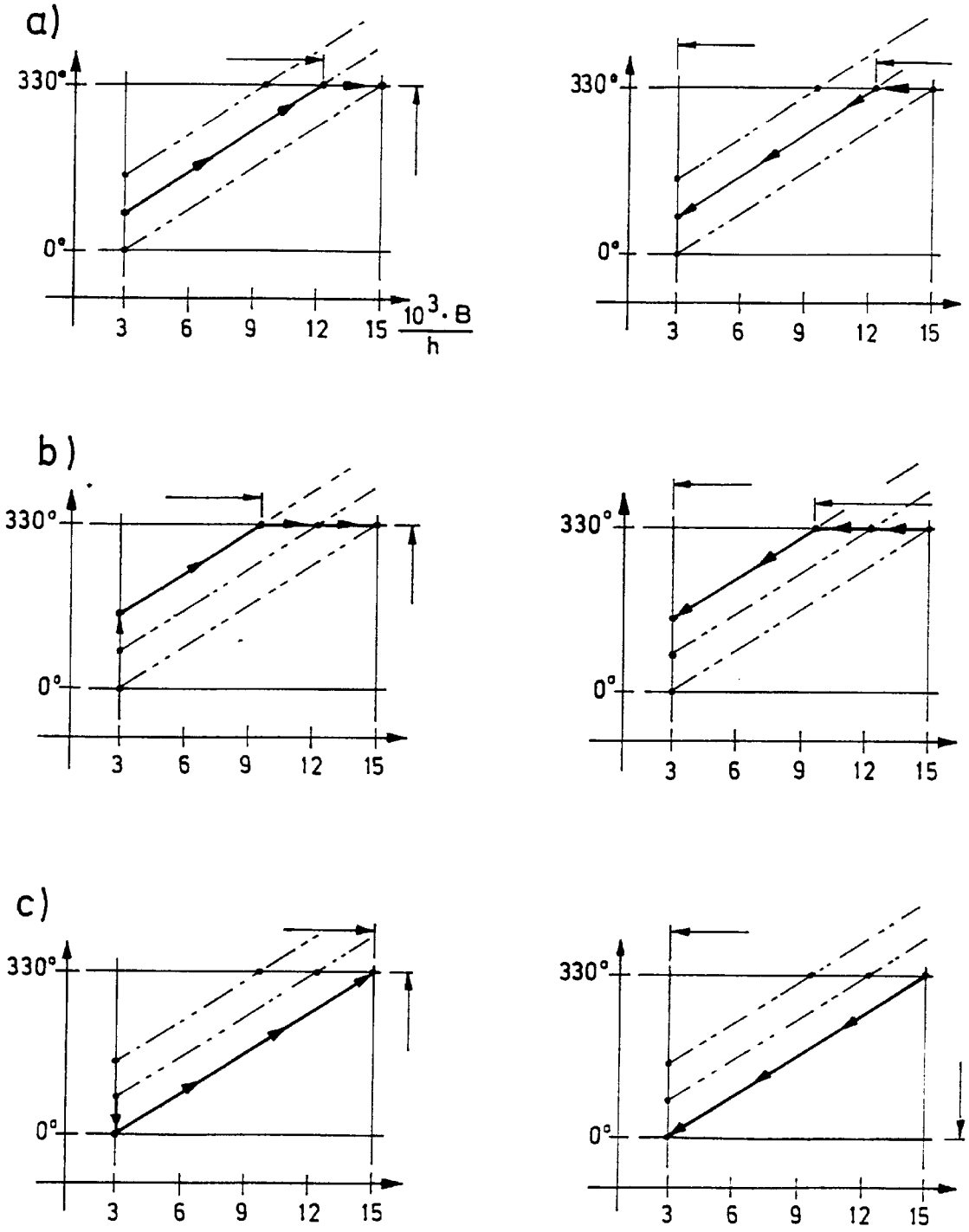
FIG. 3*a* is a pair of diagrams illustrating the tracking or follow-up of the gripper opening cam upon RPM runnup and rundown.
FIG. 3*b* is a pair of diagrams illustrating the tracking or follow-up for a gripper opening cam adjusted to early.
FIG. 3*c* is a pair of diagrams illustrating the tracking or follow-up for a gripper opening cam adjusted to late.

Possible characteristic curves for this type of electronic control are shown in FIG. 3. The two curves shown at a) in the upper portion of FIG. 3 illustrate the tracking or follow-up of the gripper opening cam, at the lefthand side upon rpm runup and at the righthand side upon rpm rundown in a sheet-fed printing press. In the middle part b) of FIG. 3, diagrams for a gripper opening cam adjusted to "early" are shown at the lefthand side upon runup and at the righthand side upon rundown of the sheet-fed printing press rpm. In the lower part c) of FIG. 3, diagrams illustrate the tracking or follow-up of a gripper opening cam, adjusted to "late" at the lefthand side upon rpm runup and at the righthand side upon rpm rundown.

Figure 4:
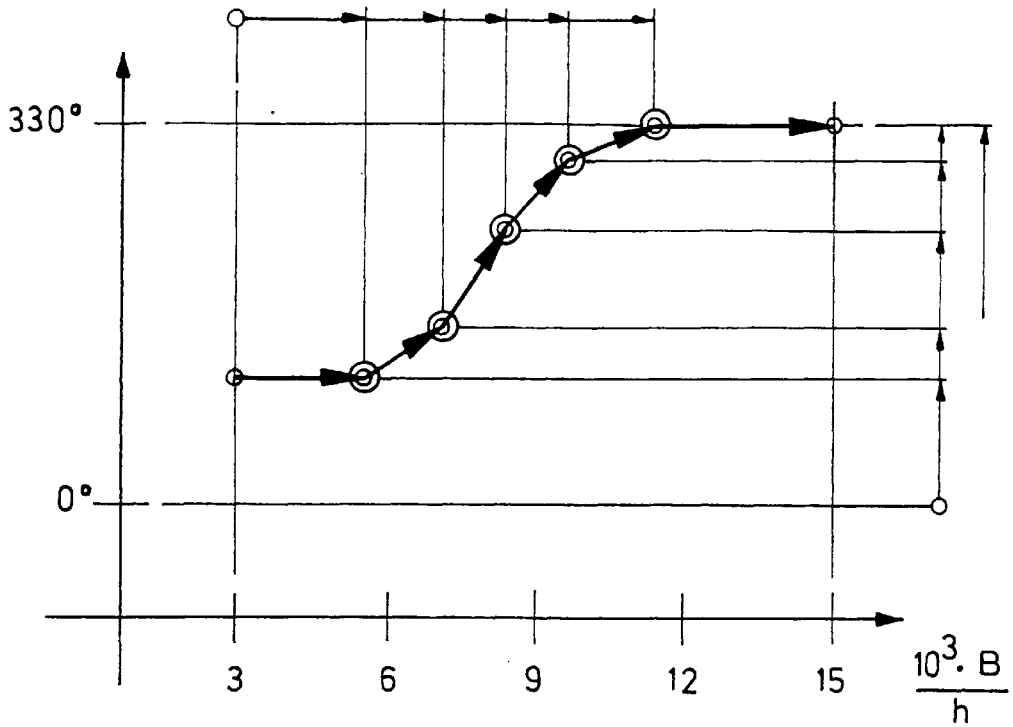
FIG. 4 is a pair of plot diagrams of control curves for the motor wherein the angular position of the gripper opening cam is shown as a function of the rpm both for runup and rundown.
Figure 4:
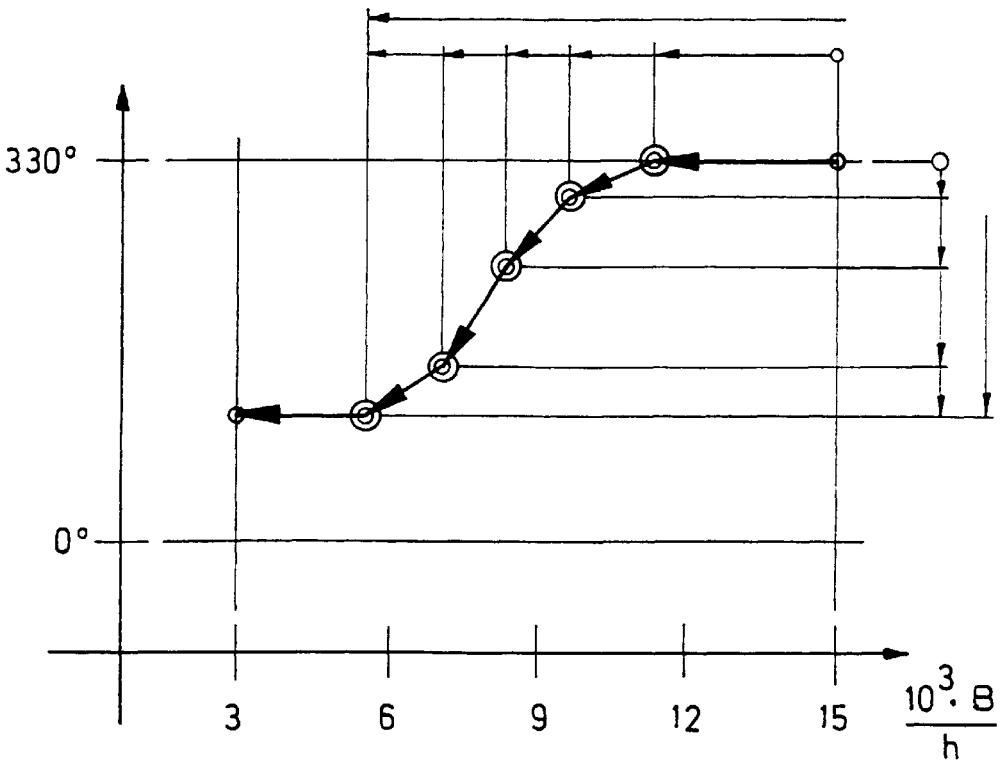

In FIG. 4, two examples for individually programmed control curves of the electronic control for the adjusting motor 12 are shown, in the upper portion thereof for the rpm runup and in the lower portion thereof for the rpm rundown. Such control curves can be formed individually by the pressman and permit him the greatest possible flexibility in controlling the gripper opening cam to adapt to varying operating conditions of the sheet-fed printing press, especially upon runup and rundown of the rpm. It is possible for the pressman to store and delete limit values, respectively, for an arbitrary runup curve or rundown curve through the use of a memory key. The standard runup curves continue to be preserved as a reference, however.

Figure 5:
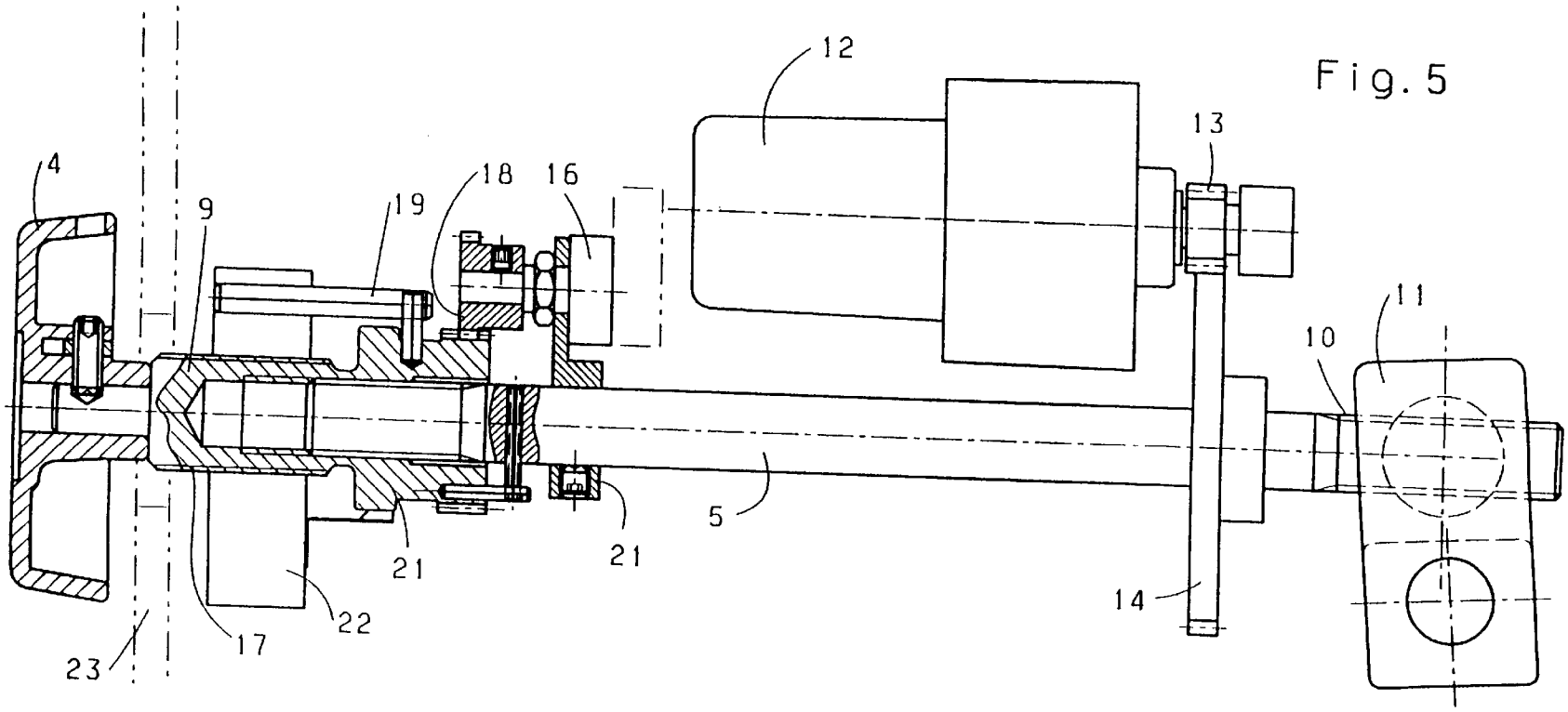
FIG. 5 is a diagrammatic side elevational view, partly broken away and in section, of a second exemplary embodiment of the invention.

The exemplary embodiment in FIG. 5 diagrammatically shows a construction of the adjusting device with the features of the invention without a clutch between the adjusting spindle 5 and the automatic adjusting drive mechanism 12 for tracking or following-up the gripper opening cam upon runup and rundown of the printing-press rpm. One of the two threaded nuts, specifically the threaded nut 9, is provided with a male thread 17 that can be screwed into a fixedly disposed female thread. This female thread is disposed, for example, in a bearing block 22, or is inserted with a threaded nut directly into a side wall 23 of the printing-press frame. The rotary angle of the threaded nut 9 relative to the bearing block 22 or the like is limited by a stop 19, against which a stub disposed on the threaded nut 9 comes to rest. Between the threaded nut 9 and the potentiometer 16, a drive 18 is provided, which transmits the change in rotary angle of the threaded nut 9 relative to the adjusting shaft 5 to the potentiometer 16. The potentiometer 16 is, in turn, secured to a slaving device or entrainer 21 disposed on the adjusting shaft 5. The potentiometer 16 thus inputs the actual position of the adjusting shaft 5 into the controller of the adjusting motor 12 for the automatic tracking or follow-up of the gripper opening cam. The adjustment of the adjusting motor 12 is transmitted to the adjusting shaft 5 by a spur gear transmission 13, 14.

Figure 6:
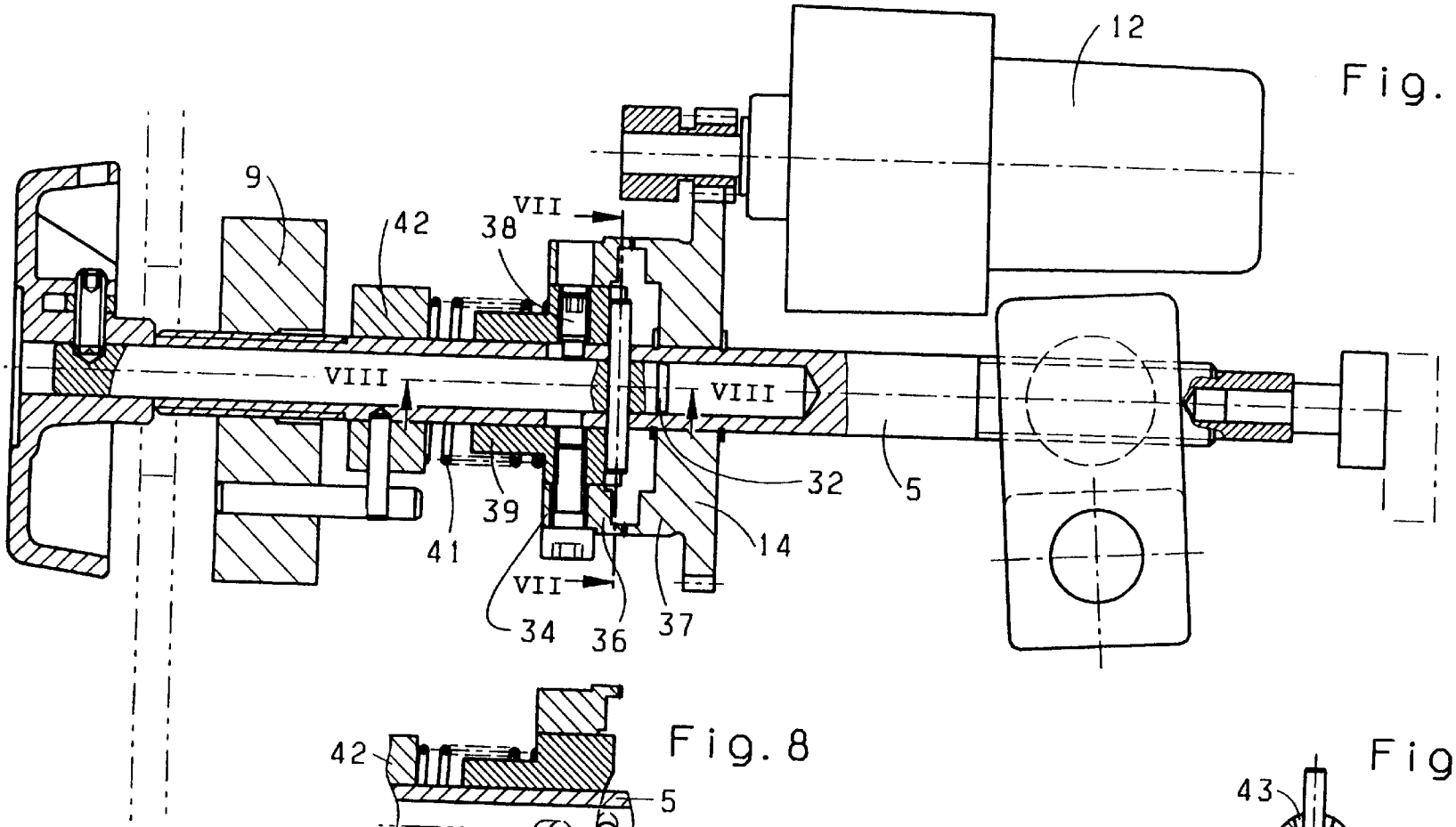
FIG. 6 is a view similar to that of FIG. 5 of a third exemplary embodiment of the invention having a shiftable clutch.
Figure 7:
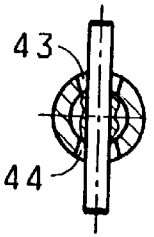
FIG. 7 is a cross-sectional view of FIG. 6 taken along the line VII—VII, in the direction of the arrows, and showing a slaving or entrainer pin in greater detail.
Figure 8:
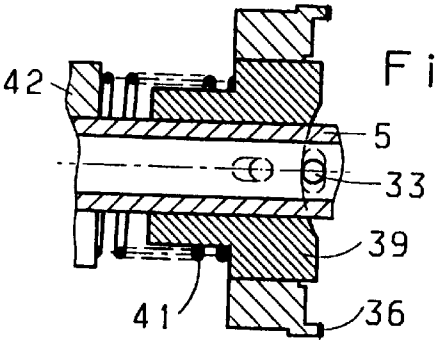
FIG. 8 is a cross-sectional view of FIG. 6 taken along the line VIII—VIII in the direction of the arrows, and showing a selector bushing in greater detail.

The exemplary embodiment in FIG. 6 diagrammatically shows a construction of the adjusting device with the features of the invention including a shiftable clutch between the adjusting spindle 5 and the automatic adjusting drive mechanism 12 for tracking or following-up the gripper opening cam upon runup and rundown of the printing-press rpm. The shiftable clutch is constructed so that the gearwheel 14 is supported rotatably on the adjusting shaft 5 and has a first clutch half 37 carrying teeth, claws or a friction lining at an end face thereof. The first clutch half 37, in this regard, cooperates with a second clutch half 36, which is constructed in a manner corresponding to that of the first clutch half 37 and is disposed on an axial cam 34. The axial cam 34 has an axially oriented control contour and is secured firmly to an axially displaceably supported selector bushing 39. The selector bushing 39 coaxially surrounds the adjusting shaft 5 and is displaceable thereon, but is supported thereon in a manner opposing rotation relative thereto by a feather key or adjusting spring device 38. In an axial bore, the adjusting shaft 5 carries a control shaft 32 coaxially, which is connected to the hand wheel 4. A slaving or entrainer pin 33 is mounted at an end of the control shaft 32 opposite the hand wheel 4 and is operatively connected to the control contour of the axial cam 34. In this regard, the slaving or entrainer pin 33 extends with great play or clearance through two slots 43 and 44 formed in the adjusting shaft 5. A restoring spring 41 coaxially surrounding the selector bushing 39, the adjusting shaft 5 and the control shaft 32 is supported at one end thereof on the selector bushing 39 and at the other end thereof on a frame-fixed spring abutment 42. To initiate an adjusting motion, the hand wheel 4 is rotated clockwise or counterclockwise to such an extent that the slaving or entrainer pin 33 inside the slots 43 and 44 strikes the adjusting shaft 5. In this regard, the slaving or entrainer pin 33, due to the contact thereof with the axial cam 34, has in the process displaced the selector bushing 39 so far counter to the force of the restoring spring 41 that the two clutch halves 36 and 37 are disconnected from one another. Further rotation of the hand wheel 4 then causes the enslaving or entrainment of the adjusting shaft 5 and, accordingly, an axial displacement of the adjusting shaft 5 initiated by the threaded nut 9. Clutch engagement is accomplished by releasing the hand wheel 4 with an attendant reverse rotation of the slaving or entrainer pin 33, which is initiated by the restoring spring 41 in combination with the contour of the axial cam 34.

Figure 9:
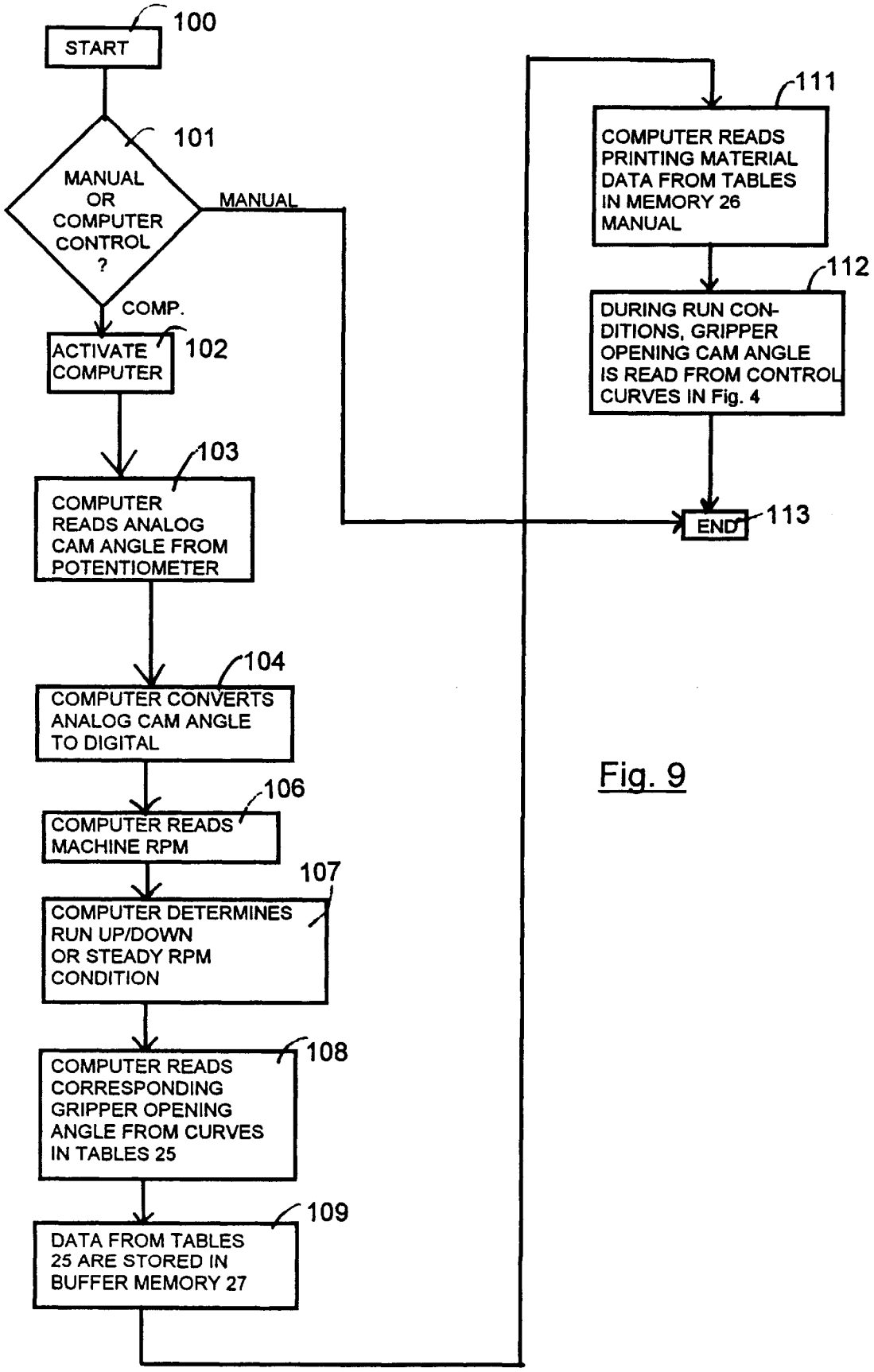
FIG. 9 is a flow chart showing the control steps in the operation of the adjusting device for a gripper opening cam.

FIG. 9 is a flow chart showing the control steps in the operation of the adjusting device for a gripper opening cam according to the invention during startup or runup, steady-state operation or production running, and rundown of the printing press. After starting at 100, a determination is made in decision step 101 whether the gripper opening cam angle is to be controlled manually or by the computer. If manual control is used, the flow chart goes to the End 113. If computer control is used, the computer 24 is activated in step 102. In step 103 the computer reads the cam angle as set by the hand wheel 4 from the potentiometer 16 as an analog signal. The computer converts the analog signal to a digital input in step 104. Next, in step 106 the computer reads the current printing-press RPM which is readily available from the ordinary press controls as is well known in the state of the printing art. From the RPM data, the computer determines if the system is in runup, rundown, or steady-state RPM condition in step 107. Next, in step 108, the computer reads the required corresponding gripper opening angles from characteristic curves stored in tables 25. Then, in step 109, the data from the tables 25 are entered in the buffer memory 27. If pertinent, in step 111, the computer reads printing material data from tables stored in the memory 26 as they may affect the gripper opening cam angle. In step 112, the computer reads the required gripper opening cam angle from the control curves shown in FIG. 4. Finally, at the end of printing operation, the End step 113 is reached.

We claim:

1. In combination:

a gripper opening cam in a chain delivery of a sheet-fed printing press;

a bearing pivotally guiding said gripper opening cam;

a pair of threaded nuts;

a linkage connected to one of said pair of threaded nuts;

an adjusting shaft having a lefthand thread and a righthand thread, one of said lefthand thread and said righthand thread connected to said one of said pair of threaded nuts;

another one of said pair of threaded nuts fixedly supported and receiving another one of said lefthand thread and said righthand thread of said adjusting shaft; and an adjusting device including an adjusting motor with an electrical program controller programmable for adapting said motor to parameters which vary as the printing press rpm runs up to and runs down from operating speed for automatically tracking said gripper opening cam, and a coupling operative in the adjusting device, said coupling being disposed between said adjusting motor and said gripper opening cam.

2. The combination according to claim 1, including a slipping clutch coupling said adjusting motor to said adjusting shaft.

3. The combination according to claim 2, including a potentiometer connected to said adjusting shaft for feeding actual-value data of said adjusting shaft into said electric controller of said adjusting motor.

4. The combination according to claim 3, wherein said electronic controller includes at least one memory storing at least one set of data for tracking the gripper opening cam when the rpm of the printing press is running up to and running down from operating speed.

5. The combination according to claim 1 including a shiftable clutch coupling said adjusting motor to said adjusting shaft.

6. The combination according to claim 5, wherein said shiftable clutch has a control shaft pivotally supported coaxially in said adjusting shaft, said adjusting shaft carrying an entrainer pin.

7. The combination according to claim 6, including an abutment; and a restoring spring coaxially surrounding said selector bushing, said adjusting shaft and said control shaft, said restoring spring disposed between said selector bushing and said abutment.

8. The combination according to claim 5, wherein said shiftable clutch has a selector bushing coaxially engaging said adjusting shaft on the outside thereof, said selector bushing having an end face and an axial cam on said end face, said axial cam being operatively connected to said entrainer pin.

9. In combination:

a gripper opening cam in a chain delivery of a sheet-fed printing press;

a bearing pivotally guiding said gripper opening cam;

a pair of threaded nuts;

a linkage connected to one of said pair of threaded nuts;

an adjusting shaft having a lefthand thread and a righthand thread, one of said lefthand thread and said righthand thread connected to said one of said pair of threaded nuts;

another one of said pair of threaded nuts fixedly supported and receiving another one of said lefthand thread and said righthand thread of said adjusting shaft;

an adjusting device including an adjusting motor with an electrical program controller programmable for adapting said motor to parameters which vary as the printing press rpm runs up to and runs down from operating speed for automatically tracking said gripper opening cam, said other one of said pair of threaded nuts having an external thread and axially adjustably engaging a fixedly disposed internal thread, said other one of said pair of threaded nuts screwably adjustable on said fixed thread by a hand wheel and a motor, a potentiometer coupled to said adjusting shaft and feeding angular positions of said adjusting shaft to said electrical program controller, said electrical program controller adapting said adjusting motor in response to said angular positions of said adjusting shaft.

10. The combination according to claim 9, wherein said other one of said pair of threaded nuts is rotatable through approximately 360° between stops, and including a drive connecting said potentiometer to said other one of said pair of threaded nuts, said potentiometer relative to said other one of said pair of threaded nuts is limited to a rotation through approximately 360° between stops.

* * * * *